US005269064A

United States Patent [19]

Greene et al.

[11] Patent Number: 5,269,064

[45] Date of Patent: Dec. 14, 1993

[54] CHAIN SAW CUTTER BAR AND SAFETY GUARD

[76] Inventors: Gordon C. Greene; Barbara L. Gray-Greene, both of 36890 Hwy. 31, Summer Lake, Oreg. 97640

[21] Appl. No.: 950,225

[22] Filed: Sep. 24, 1992

[51] Int. Cl.[5] ..... B27B 17/02

[52] U.S. Cl. ..... 30/382; 30/371

[58] Field of Search ..... 30/381, 382, 286, 371; 83/814, DIG. 1; 144/251 R

[56] References Cited

U.S. PATENT DOCUMENTS

| | | | |
|---|---|---|---|
| 1,642,668 | 9/1927 | Brey . | |
| 2,447,298 | 8/1948 | Whitlock . | |
| 2,638,944 | 5/1953 | Woleslagle | 30/371 |
| 2,708,953 | 5/1955 | Diehl | 30/371 |
| 2,826,294 | 3/1958 | Nicodemus | 30/382 |
| 2,937,673 | 5/1960 | Duperron et al. . | |
| 3,040,790 | 6/1962 | Goodson . | |
| 3,059,673 | 10/1962 | Woleslagle | 30/382 |
| 3,182,695 | 5/1965 | Rigoni . | |
| 3,230,987 | 1/1966 | Woleslagle . | |
| 3,292,671 | 12/1966 | Stromberg | 30/382 |
| 3,384,136 | 5/1968 | Marin | 30/382 |
| 3,540,500 | 11/1970 | Greene | 83/821 |
| 3,754,328 | 8/1973 | Knerr | 30/382 |
| 3,808,684 | 5/1974 | Ludwig | 30/382 |
| 4,060,894 | 12/1977 | Hampton | 30/382 |
| 4,063,358 | 12/1977 | Hodge | 30/382 |
| 4,257,162 | 3/1981 | Pardon | 30/382 |
| 4,272,889 | 6/1981 | Scott et al. | 30/382 |
| 4,447,953 | 5/1984 | Lombardino et al. | 30/382 |
| 4,621,426 | 11/1986 | Shivers | 30/382 |
| 4,945,641 | 8/1990 | Miller et al. | 30/382 |
| 4,991,297 | 2/1991 | Cain | 30/382 |
| 5,074,047 | 12/1991 | King | 30/382 |

*Primary Examiner*—Douglas D. Watts
*Assistant Examiner*—Hwei-Siu Payer
*Attorney, Agent, or Firm*—Kolisch, Hartwell, Dickinson, McCormack & Heuser

[57] ABSTRACT

A chain saw safety guard is provided for protecting against accidental contact with the longitudinal side edges of a chain saw cutter bar. The safety guard includes a generally U-shaped guard member having two parallel guard rails which extend to the open end of the U and a cross-piece or cross-member at the closed end of the U. The guard is supported on the cutter bar at its forward or outermost end by means of a track on the bar and a follower coupled to the guard member. The guard rails are supported near the proximal end of the cutter bar on slidable supports which allow the rails to move longitudinally along the cutter bar to retract and expose the cutting edges of the saw. A telescoping version of the guard member, in which the guard rails telescope into a more compact configuration, is also disclosed. A movable track on the cutter bar, in the form of a longitudinal slot through the bar, helps cool the cutter bar.

16 Claims, 2 Drawing Sheets

CHAIN SAW CUTTER BAR AND SAFETY GUARD

BACKGROUND AND SUMMARY OF THE INVENTION

The invention relates generally to chain saws and more particularly to an improved cutter bar and cutter bar safety guard which protects against accidental contact with the saw chain carried on the longitudinal side edges of a cutter bar.

Chain saws are inherently dangerous implements for both experienced and inexperienced operators. Even the briefest accidental contact between the saw operator and a moving saw chain can cause serious and often permanent injury. Because of the potential for dangerous accidents, numerous devices have been developed and patented over the years to protect the chain saw operator. Examples of prior art safety guards include devices which extend along one edge of the cutter bar and pivot out of the way, as shown in U.S. Pat. Nos. 3,384,136 and 4,060,894; pivoting covers which fully or partially sheath the cutter bar and pivot out of the way during use, as shown in U.S. Pat. Nos. 3,059,673 and 4,257,162; or a telescoping full saw enclosure which collapses out of the way of the cutter bar, as shown in U.S. Pat. No. 2,638,944. Many of these prior art devices are cumbersome to use, can become clogged with sawdust and wood chips, and may seriously interfere with the operator's view of the cutter bar when the saw is in use. For these and other reasons, most chain saw safety guard devices remain unpopular with saw owners and manufacturers.

It would be advantageous to have a chain saw safety guard device which did not obstruct the operator's view of the cutter bar or the object being cut.

It would also be advantageous to have a chain saw safety guard which only minimally interfere with cutting operations.

It would also be advantageous to have an improved cutter bar for chain saws which avoided overheating and was compatible with the safety guard of the present invention.

Accordingly, the present invention provides a chain saw safety guard for protecting against accidental contact with the longitudinal side edges of a chain saw cutter bar. The safety guard comprises a generally U-shaped guard member which includes a pair of guard rails extending generally parallel with one another to the open end of the U, and a cross-piece extending between the rails at the closed end of the U. Rail supports are provided on the chain saw for supporting the rails of the guard member such that the rails are longitudinally adjacent and spaced from the side edges of the cutter bar. The rail supports permit longitudinal movement of the rails along the side edges of the cutter bar. And a forward support is provided which includes a longitudinal track o the cutter bar and a track-engaging traveler operatively connected to the cross-piece of the guard member. The guard member is supported relative to the cutter bar at three points, the two rail supports and the forward support. It is movable longitudinally along the cutter bar to expose the side edges thereof when the chain saw is used to cut objects.

The preferred form of the safety guard includes a longitudinal slot in the cutter bar, extending generally along portions of the central longitudinal axis of the cutter bar. The slot is part of the longitudinal track on the forward support of the cutter bar. The safety guard preferably extends only part of the way to the tip or distal end of the cutter bar. In other words, when the guard is fully extended, the side rails and cross-piece are spaced a predetermined distance back from the tip of the cutter bar. That allows the chain saw operator to engage an object being cut using the traveling saw chain on the "unguarded" tip of the cutter bar. As the user begins to cut into the object, the object engages and pushes against the outer end of the safety guard, causing it to retract along the cutter bar, which exposes the side edge of the cutter bar so the object can be cut.

The invention also provides an improved chain saw cutter bar of the type which is attached to a chain saw motor housing at its proximal end and which includes an elongated inflexible plate member extending outwardly therefrom. The cutter bar has a width and length substantially exceeding the thickness of the plate member. It also has a guide groove extending along portions of its periphery for guiding a saw chain along the longitudinal side edges of the cutter bar, and around the tip of the cutter bar. The improvement of the present invention comprises one or more openings which extend through the plate member to cool the cutter bar. The openings preferably include a longitudinally-extending elongated slot which cools the bar and which also serves as a track on the cutter bar for the forward support of the safety guard.

DETAILED DESCRIPTION OF THE PREFERRED EMBODIMENT

Figure 1:
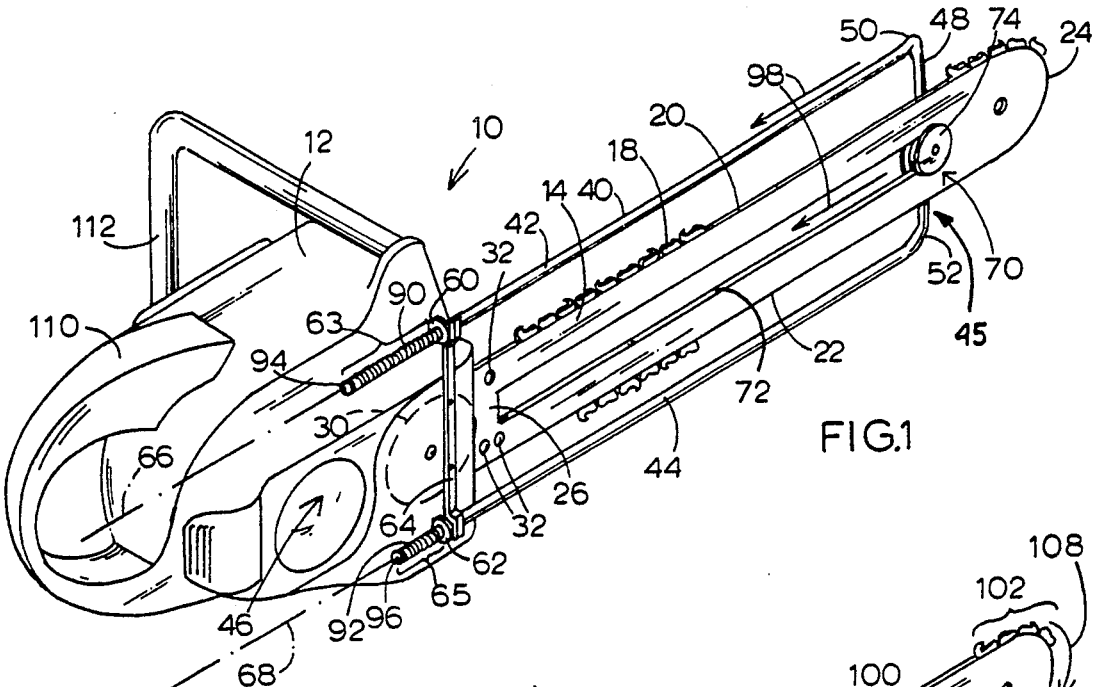
FIG. 1 is a partially schematic perspective view of a chain saw incorporating a first embodiment of the chain saw safety guard of the present invention, with the safety guard in its fully extended position.

Referring to FIG. 1, a first embodiment of the chain saw safety guard of the present invention is illustrated in place on a chain saw 10. The chain saw includes a conventional motor housing 12 which encloses a gas or electric motor (not shown) to drive an elongated multi-link saw chain 18. The saw chain is shown schematically in the figures, with short segments of the chain illustrated along portions of the saw cutter bar 14. Saw chain 18 actually extends continuously around the peripheral edge of cutter bar 14 in the manner well known to those skilled in the art. The drive mechanism for chain 18 (not shown) is conventional and forms no part of the present invention.

Extending outwardly from motor housing 12 is cutter bar 14, which is an elongated and inflexible plate member, usually made of steel, which has a guide groove extending around portions of its periphery for guiding and carrying saw chain 18. The path of saw chain 18 is outwardly along the upper longitudinal side edge 20 of the cutter bar, around the tip 24, and inwardly (i.e., toward motor housing 12) along lower longitudinal side edge 22 of the cutter bar. Cutter bar 14 is attached to the motor and motor housing 12 of chain saw 10 at its proximal (i.e., inner) end 26 by means of bolts 32. The motor in housing 12 drives a chain sprocket, indicated schematically by dashed circle 30, around which saw chain 18 extends. Bolts 32 are used to adjust the tension on saw chain 18 and to install and remove cutter bar 14 and chain 18.

The first embodiment safety guard of the present invention includes a generally U-shaped guard member 40 made from a unitary length of tubing, or from a piece of elongated bar material which is bent or molded into the form shown. Solid tubular aluminum or steel tubing, ⅜-inch in diameter, is a preferred material for fabricating guard member 40. Alternatively, guard member 40 can be made of a hard plastic or composite tubular material of a type which can be bent or formed into a U-shape.

Guard member 40 is generally squared off at its closed end 45, giving it the overall shape of a long staple, with two relatively sharp compound 90° bends. At its open end 46, guard member 40 consists of a pair of generally parallel, elongated, straight rails 42, 44 which extend generally parallel with one another from closed end 45 toward motor housing 12. A cross-piece 48, which is part of guard member 40, extends between rails 42, 44 at closed end 45. A pair of compound 90° bends 50, 52 form the respective upper and lower corners of the guard member (as viewed in FIG. 1), where it transitions between the rails 42, 44 and the cross-piece 48. Corners 50, 52 are compound double bends which result in a planar offset between rails 42, 44 and cross-piece 48.

Figure 2:
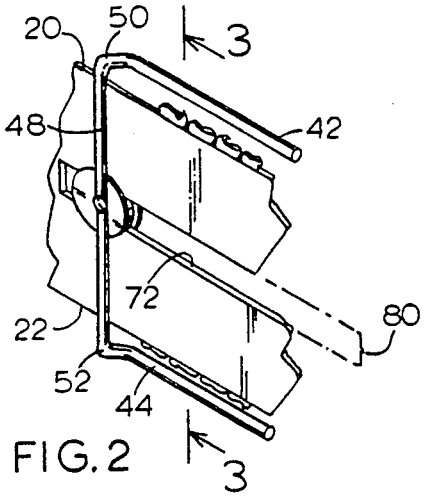
FIG. 2 is a partial, partially schematic view of a portion of the cutter bar and safety guard shown in FIG. 1, shown from the other side of the cutter bar.
Figure 3:
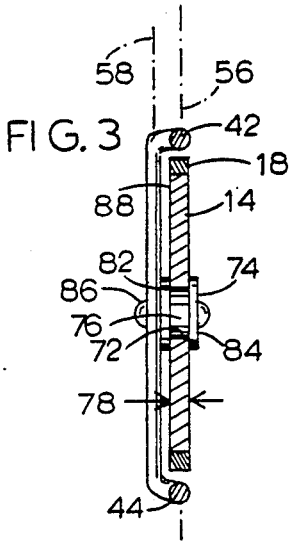
FIG. 3 is a cross-sectional view of the cutter bar and safety guard of FIGS. 1 and 2, taken along lines 3—3 of FIG. 2.

Referring to FIGS. 2 and 3, when guard member 40 is installed on the chain saw, rails 42, 44 preferably extend longitudinally adjacent and spaced from the longitudinal side edges 20, 22 of cutter bar 14, generally in the plane 56 of the cutter bar, cross-piece 48 extends across the width of cutter bar 14 (the width being the dimension between side edges 20 and 22), in a plane 58 which is slightly offset from the plane 56 of rails 42, 44 and of cutter bar 14. The offset between cross-piece 48 and rails 42, 44 provides clearance between the guard member and the cutter bar and helps position the safety guard properly relative to the cutter bar.

Guard member 40 is supported on the chain saw 10 by a three-point support means which includes a pair of rail supports 60, 62 located at or near the proximal end 26 of cutter bar 14. The rail supports are preferably circular eyelets or tubular slide bearings secured either to motor housing 12 or to cutter bar 14 by a suitable bracket 64. In FIG. 1 the rail supports are mounted on housing 12 by bracket 64. Alternatively, rail supports 60, 62 can be formed integrally with the chain saw housing 12, eliminating the need for bracket 64. Rail supports 60, 62 form the rear support assembly for guard member 40. The supports permit longitudinal (i.e., axial) movement of rails 42, 44 along their respective longitudinal axes of movement 66, 68. The spacing between rail supports 60, 62 is the same as the spacing between guard rails 42, 44, with the rails and rail supports located generally in the plane of the peripheral edge of cutter bar 14.

The outer or forward end 45 of guard member 40 (where cross-piece 48 interconnects rails 42, 44) is supported on cutter bar 14 by means of a forward support 70 which is movable along the cutter bar. Forward support 70 includes a longitudinal track 72 on cutter bar 14 in the form of an elongate longitudinal slot in the central plate of the cutter bar. A traveler mechanism 74, referred to as a track-engaging traveler, is operatively connected to cross-piece 48 on guard member 40. Traveler 74 is preferably a slider or roller assembly which is fixed laterally within slot 72 and is free to move longitudinally along the slot.

FIGS. 1, 2 and 3 illustrate the parts of traveler 74. A narrow sleeve roller 76, which has a width generally corresponding to the thickness 78 of the cutter bar, rides within slot 72. The diameter of sleeve roller 76 is preferably approximately equal to the width 80 of slot 72 (see FIG. 2). A pair of keepers 82, 84 in the form of washers or the like, with each having a diameter larger than the width 80 of slot 72, hold the traveler 74 in place within the slot. A bolt or rivet 86 extending through cross-piece 48 and through traveler 74 completes the assembly. The lateral spacing between cross-piece 48 and the closest adjacent surface 88 of cutter bar 14 is determined by the thickness of intervening keeper washer 82. That spacing can be increased by inserting additional washers or spacer elements (not shown) between the cross-piece and cutter bar, if desired. The spacing needs to be sufficient to provide clearance between the guard member and the cutter bar and saw chain 18 or the guard will interfere with the operation of the chain saw.

One or more extension springs 90, 92 are provided adjacent the open end 46 of guard member 40 to serve as biasing devices for urging guard member 40 to its extended position, shown in FIG. 1. In its extended position, the guard member is closest to the distal end or tip 24 of cutter bar 14. Springs 90, 92 are preferably helical extension springs which fit around the outside of the rearward extensions of the guard rails. The rearward extensions 63, 65 of respective rails 42, 44 protrude through and beyond rail supports 60, 62 along motor housing 12. By installing springs 90, 92 on these extensions, the springs are out of the way of the working parts of the chain saw. One end of helical spring 90 is preferably secured to the terminal end 94 of rail 42 and the other end of spring 90 is secured to rail support 60. One end of spring 92 is preferably secured to the terminal end 96 of rail 44 and the other end of spring 92 is secured to rail support 62.

Figure 4:
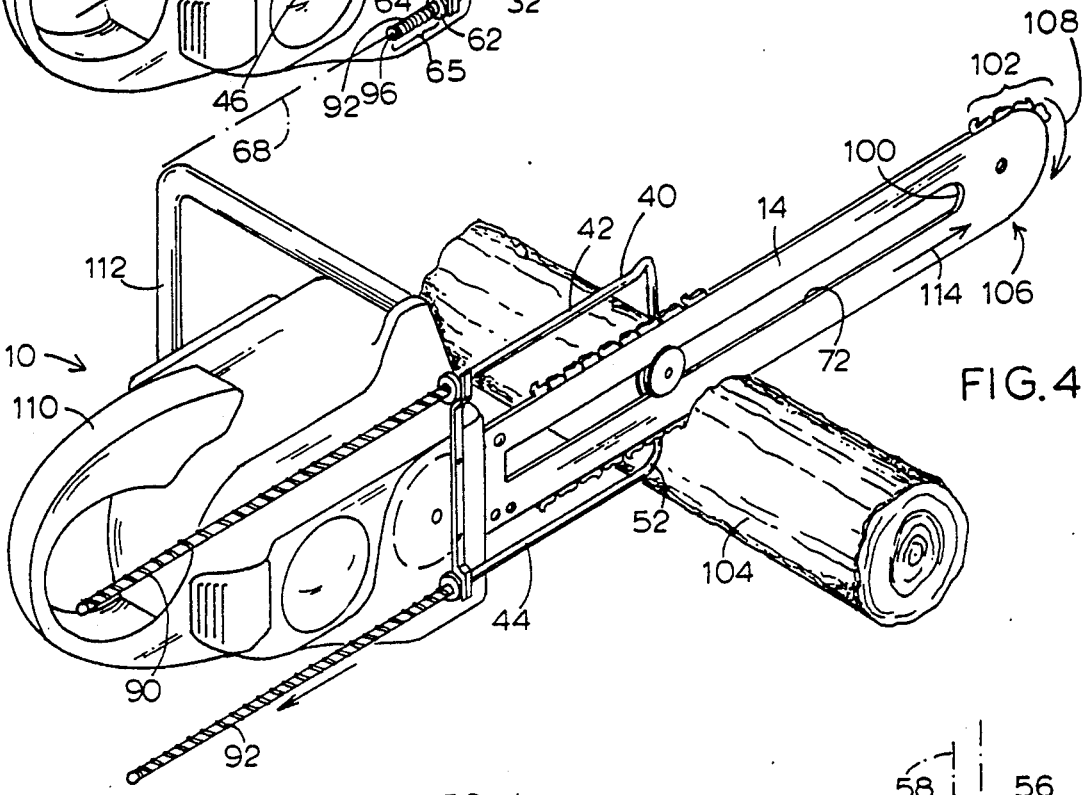
FIG. 4 is a partially schematic view of the cutter bar and safety guard of FIG. 1 cutting into an object, with the safety guard in a retracted position.

As guard member 40 retracts in the direction of arrows 98, springs 90, 92 expand, as shown in FIG. 4, urging the safety guard outwardly toward its extended position shown in FIG. 1. The limit of outward (i.e., distal) movement of guard member 40 is determined by the forward end 100 of slot 72. When traveler 74 reaches that forward limit, the guard member is fully the nose end 24 of the cutter bar. If it extended closer to the end of the cutter bar 14, it would interfere with the internal forward sprocket (not shown) which is used to carry the saw chain around the nose of the cutter bar. The forward end 100 of slot 72 represents a stop point for forward movement of the forward safety guard support 70. Stop point 100 is a predetermined distance (e.g., 3–4-inches) rearward of the nose end 24 of the cutter bar.

The operation of the first embodiment safety guard will be described with reference to FIGS. 1 and 4. Whenever the chain saw user desires to cut an object, such as the piece of wood 104 illustrated in FIG. 4, it is necessary to retract guard member 40 to approximately the position shown in FIG. 4. That is accomplished by bringing the underside of the exposed nose portion 102 of cutter bar 14 (the underside being indicated at 106 in FIG. 4) against the target object 104, while the saw chain 18 is moving. Since saw chains on most conventional saws move in the direction of arrow 108 (i.e., clockwise as viewed in FIGS. 1 and 4), the saw teeth on the chain will engage the target object 104 and tend to pull the cutter bar and saw toward the object as it is being cut. That pulls the saw 10 away from the operator holding handles 110, 112, in the direction of arrow 114. To move the guard, the user simply allows the moving chain to draw cutter bar 14 forward in the direction of arrow 114 to a comfortable cutting position, while the guard member 40 pushes against the target object 104. As the saw and cutter bar move in direction 114, guard member 40 retracts. Springs 90, 92 begin to extend as the guard rails 42, 44 move rearwardly. Once the guard member has been retracted, cutting can proceed normally until the target object 104 has been cut through, at which time the cutter bar is removed from the target object and the guard member 40 returns to its initial position, shown in FIG. 1, under the force exerted by springs 90, 92.

Should saw 10 buck, kick or jump up from the target object at any time, guard member 40 will immediately snap back into its fully extended position shown in FIG. 1. The operator must then begin cutting by again resting the lower nose portion 106 of the cutter bar against the target object and guiding the saw and cutter bar to retract the guard member 40. The retracting process is simple and effortless since the movement of the cutting chain assists the user in overcoming the tension of springs 90, 92. After using a saw equipped with the safety guard of the present invention for even a short period of time, the operator will quickly get used to the process of retracting the guard member. For an experienced operator, retraction of the guard takes virtually no time at all.

Figure 5:
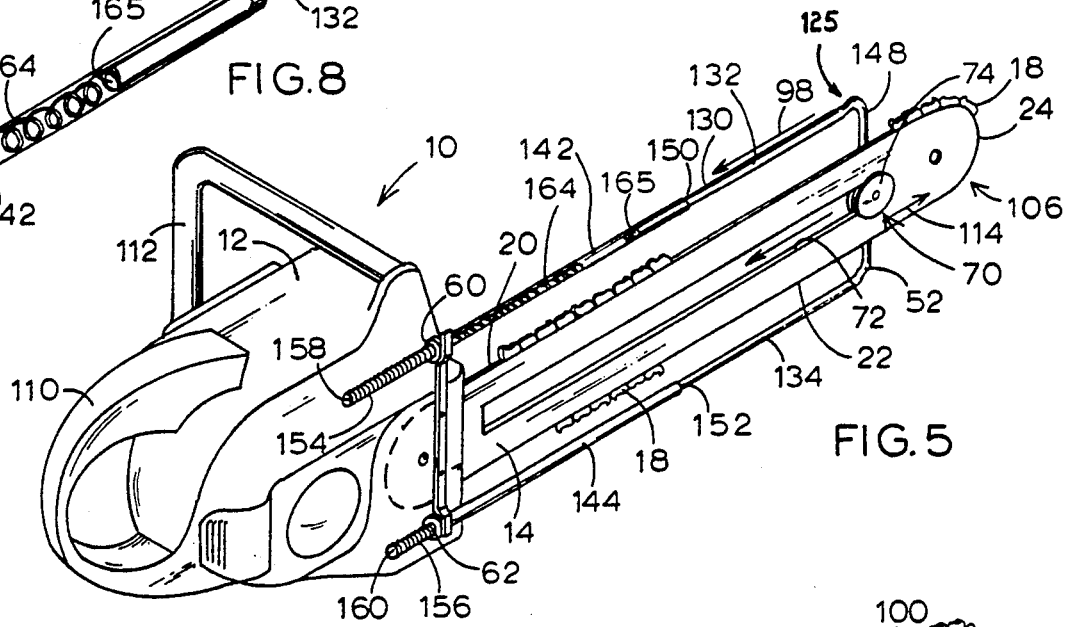
FIG. 5 is a partially schematic view of a chain saw showing a second embodiment of the safety guard, incorporating telescoping rail members, with the safety guard in its fully extended position.
Figure 6:
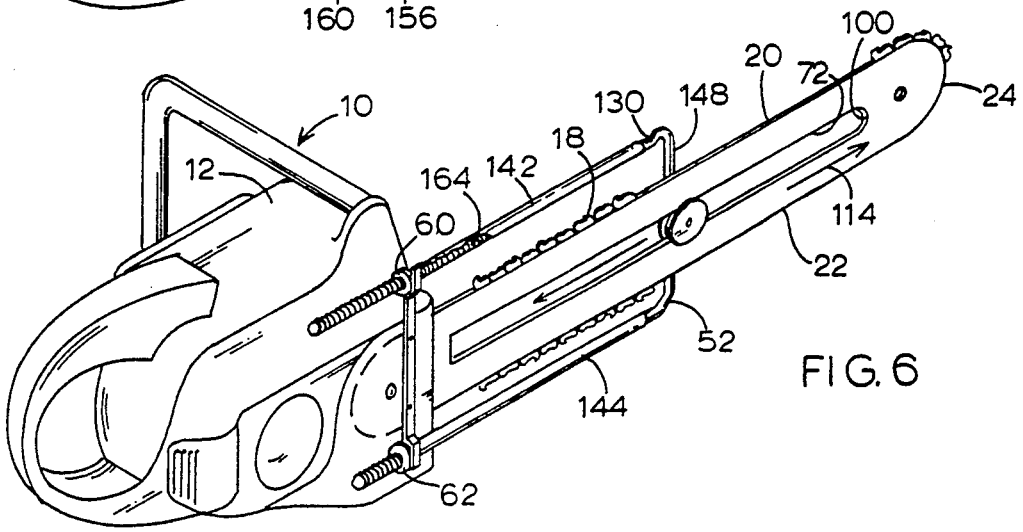
FIG. 6 is a partially schematic view as in FIG. 5 showing the safety guard in a partially retracted position.
Figure 7:
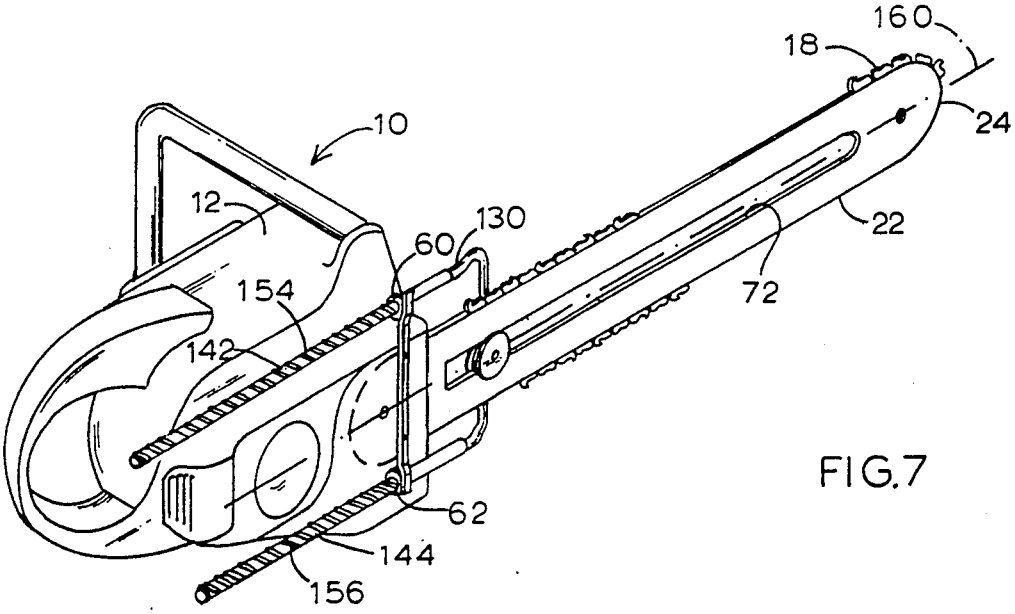
FIG. 7 is a partially schematic view as in FIGS. 5 and 6 showing the safety guard in its fully retracted position.

A second embodiment of the invention is shown in FIGS. 5, 6 and 7. The same reference numbers are used in FIGS. 5–7 for identical elements previously identified in FIGS. 1–4. In the second embodiment, chain saw 10 is provided with a telescoping version 125 of the chain saw safety guard of the present invention. The telescoping safety guard is for use on saws with longer cutter bars, or when space is at a premium. Safety guard 125 includes a U-shaped guard member 130 with parallel guard rails 132, 134 which telescope, respectively, into cooperating tube members 142, 144. The U-shaped guard member 130 is essentially the same as member 40 in the first embodiment, except that guard rails 132, 134 are generally shorter than the guard rails in the first embodiment. Like the first embodiment, guard member 130 includes a cross-piece 148 extending between rails 132, 134 at the closed end of the U. A forward support 70 for cross-piece 148 is identical with the forward support shown in FIGS. 1–4. Traveler 74 is movable longitudinally within slot 72 on cutter bar 14 to support the forward end of the safety guard.

Guard rails 132, 134, are generally parallel with one another and are mounted on saw 10 to extend longitudinally adjacent and spaced from the side edges 20, 22 of the chain saw cutter bar 14. The inner ends of rails 132, 134 extend into the open ends 150, 152 of telescoping tubes 142, 144, respectively, to form an operative telescoping coupling. Tubes 142, 144 are coaxial to rails 132, 134, respectively. As guard member 130 moves inwardly along cutter bar 14 in the direction of arrow 98, guard rails 132, 134 slide into the interiors of respective tubes 142, 144. In that way, the guard collapses down and has a shorter overall length as it retracts toward the chain saw housing 12.

Tubes 142, 144 are respectively supported on, and form part of, the rail support of the safety guard. Rail support bracket 64 and eyelets 60, 62 are identical with the rail supports of the first embodiment. A double set of springs is provided in the second embodiment safety guard to urge guard member 130 and telescoping tubes 142, 144 outwardly in the direction opposite to arrow 98. A first set of springs, forming a first biasing means, is a pair of helical extension springs which urge tubes 142, 144 outwardly in the manner of springs 90, 92 in the first embodiment. One end of spring 154 is attached to the terminal end 158 of telescoping tube 142 and the other end of spring 154 is attached to rail support 60. One end of spring 156 is attached to the terminal end 160 of tube 144 and the other end of spring 156 is attached to rail support 62. Springs 154 and 156 urge tubes 142 and 144, respectively, toward the distal end of the cutter bar.

Figure 8:
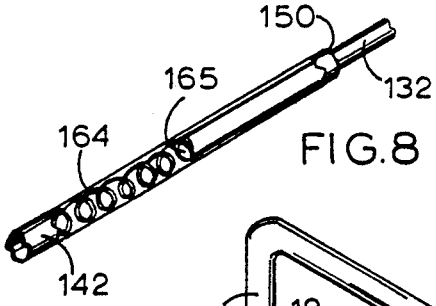
FIG. 8 is a partial perspective view, on an enlarged scale, of a segment of the telescoping guard rail shown in FIG. 5.

A second biasing means for urging guard member 130 toward the distal end of cutter bar 14 is provided in the form of a internal compression spring 164 within telescoping tube 144. As guard member 130 retracts, the inner end 165 of rail 130 on guard member 125 slides into tube 142 and compresses spring 164 within tube 142. Spring 164, in turn, urges rail 130 outwardly. An enlargement of a segment of the telescoping guard rail, where side rail 132 extends into telescoping tube 142 through opening 150, is shown in FIG. 8. The inner end 165 of rail 132 presses against compression spring 164. A second spring equivalent to spring 164 can be provided within telescoping tube 144, if necessary. Should a second compression spring be provided within tube 144, it would engage the inner end (not shown) of guard rail 134 in the same manner as is shown in FIG. 8 for guard rail 132.

In general, it has been found desirable to select springs 154, 156 and 164 to allow the internal compression spring 164 to yield first, as guard 125 retracts, before extension springs 154, 156 begin to extend significantly. That causes guard member 130 to telescope more or less fully into tubes 142, 144, as shown in FIG. 6, before the tubes begin to move rearwardly. For that reason, only a single spring 164 may be needed in the telescoping tubes, although a pair of relatively low-force springs could be used to accomplish the same telescoping sequence.

Operation of the second embodiment of FIGS. 5–7 is the same as for the first embodiment. The user will first rest the lower nose region 106 of the cutter bar on the target object to be cut, with the saw chain moving. The moving chain 18 will tend to pull the cutter bar and saw forwardly, in the direction of arrow 114, causing the lower corner 52 of the guard member to engage the target object and push guard member 130 rearwardly. As noted above, the guard member 130 first slides into tubes 142, 144, as shown in FIG. 6. As retraction continues, the rearward motion of guard member 130 pushes tube members 142, 144 rearwardly through rail supports 60, 62, respectively, extending springs 154, 156. Should the user lift the cutter bar from the target object, or should the saw jump or buck, the tension of springs 154, 156 and the compression of spring 164 will cause tubes 142, 144 and guard member 130 to snap back to the fully extended position shown in FIG. 5.

Both the first and second embodiments of the chain saw cutter guard protect the user against injury by extending a rigid guard rail member adjacent each longitudinal side edge of the chain saw cutter bar. Whenever the saw is not in use cutting an object, the guard rails are fully extended. Only when the saw is actually cutting into an object is the guard member retracted. The three-point mounting system for the safety guard, including the pair of proximal supports 60, 62 at the inner end of the cutter bar and the forward support physically mounted on and attached to the cutter bar, ensures that the guard will remain securely positioned relative to the cutter bar. In particular, the slidable forward support ensures that the guard does not shift laterally relative to the cutter bar even if the chain saw is dropped, or if a strong lateral impact strikes the guard. Provision of a forward sliding support on the cutter bar also means that the safety guard assembly need not be supported entirely from the chain saw housing, which is the case with many prior art safety devices. Consequently, the guard rail supports 60, 62 can be relatively lightweight, such as simple eyelets or sleeves, and need not be heavy cantilever supports.

In addition to serving as a forward support track on the cutter bar, the elongated longitudinal slot 72 which extends through the cutter bar has been found to greatly help in cooling the cutter bar during operation of the chain saw. Conventional chain saw cutter bars are made from an elongate inflexible plate member, usually made of steel. The steel plate on a typical cutter bar is 3/16-inch thick and includes a guide groove extending along portions of its peripheral edge for guiding and carrying the saw chain. At the outer end or tip of the cutter bar, the groove is greatly enlarged in depth to form a forward cavity in which a chain sprocket is positioned to carry the saw chain around the curved forward tip of the cutter bar. At its proximal end, where the cutter bar attaches to the chain saw motor housing, most conventional cutter bars include bolt holes or slots to secure the bar to the chain saw housing. The present invention provides an improvement to conventional cutter bars in the form of openings through the plate member of the cutter bar which cool the cutter bar. Although one or more openings of any suitable shape would perform the cooling function, an elongated slot opening allows for both the cooling function and provides support to the forward end of a guard member like that of the present invention. Consequently, it is preferred that the opening through the plate of the cutter bar be an elongated slot extending generally longitudinally along a major portion of the length of the cutter bar. More specifically, the slot preferably extends along a major portion of the central longitudinal axis of the cutter bar, the axis being the central longitudinal midpoint of the bar, extending lengthwise down its center.

It has been found that the formation of openings in the central portion of a chain saw cutter bar, in the region where most cutting is done when the chain saw is in use, in no way interferes with the performance of the chain saw. Instead, the openings cool the bar, which helps to reduce wear and prolongs the life of the cutter bar.

The safety guard of the present invention is lightweight, is not subject to clogging or binding due to sawdust or wood chips, and provides effective protection against accidental contact with the longitudinal side edges of the cutter bar. The safety guard has a minimal impact on the normal operation of a chain saw. It leaves the cutter bar and chain fully visible to the saw operator. Although the safety guard rails do not extend all the way to the tip of the cutter bar, the rails do protect the user from accidental contact with the most commonly encountered portions of the cutter bar. The purpose of the safety guard is not to fully enclose or completely eliminate contact with all parts of the cutter bar. That cannot be done without using cumbersome housings which so greatly interfere with the normal operation of the saw that they tend to present other safety problems.

The invention provides substantial protection against accidental contact with the longitudinal side edges of the chain saw cutter bar. Should the saw jump or buck while in use, the guard snaps to its fully extended position to prevent injury. With the guard on the saw, the saw can be more safely transported. The cutter bar can be rested on the user's shoulder or lifted and moved without touching the saw chain. A slotted cutter bar, with rail supports 60, 62 mounted directly on the cutter bar near its proximal end, and with the forward slot-engaging traveler installed, can be sold as a single assembly for easily retrofitting of existing chain saws. Retrofitting would be accomplished by removing the conventional cuter bar on the chain saw and replacing it with the slotted cutter bar and guard member of the present invention. The guard member can be made of a variety of lightweight, strong, inflexible materials such as aluminum, steel or plastics.

Other alternative embodiments are possible within the scope of the present invention. For example, the U-shape of guard member 40 can be modified to extend side rails 42, 44 slightly forward of the stop point at the forward end of slot 72. The result would be a cutter bar shaped something like a "M." Although a unitary guard member made of a length of tubing material bent to its final shape is shown and described, the guard member can be formed of multiple separate pieces secured to one another. An example of such a guard structure would be a pair of parallel rail members interconnected by a separate cross-piece which is bolted or otherwise attached to the rail members. A cross-piece could also be added between the telescoping tube members 142, 144 in the second embodiment. The cross-piece would be slidably secured to the longitudinal slot in the cutter bar to provide additional lateral support to the chain saw guard. Yet another variation on the chain saw safety guard would be a built-in guard, integrally incorporated into the chain saw structure, instead of being an add-on to a conventional prior art chain saw. Such an integrated safety guard would incorporate rail supports 60, 62 as part of the motor housing, eliminating the need for bolt-on bracket 64. The chain saw housing could also enclose the rearward extensions 63, 65 of the guard rails in such a built-in version of the safety guard. Telescoping tubes, as used in the second embodiment, would preferably be employed in the fully enclosed version because it saves space. Yet another alternative embodiment of the safety guard could employ a plurality of telescoping tubes which successively telescope into one another, creating a compound telescoping structure which would be more compact than either the first or second embodiments, when the safety guard is fully retracted. Other variations in the safety guard are possible within the scope of the present invention.

What is claimed is:

1. A chain saw safety guard for protecting against accidental contact with longitudinal side edges of a chain saw cutter bar during cutting of a target object, the safety guard comprising:

a generally U-shaped guard member which includes a pair of guard rials extending generally parallel with one another between an open end of the U and a closed end of the U, a cross-piece extending between said rials adjacent said closed end, rail supports interposed the cutter bar and the guard rails for supporting said rails in positions longitudinally adjacent and spaced from the side edges of the cutter bar, said rail supports permitting longitudinal movement of said rials along the side edges of the cutter bar, and a forward support which includes a longitudinal track fixed relative to the cutter bar and a track-engaging traveler operatively connected to said cross-piece and reciprocally movable on and along said track, whereby said guard member is supported relative to the cutter bar on said rail supports and said forward support, and said guard member is movable longitudinally along the cutter bar to expose the side edges of the cutter bar upon longitudinal engagement of said guard member by the target object.

2. A chain saw safety guard as in claim 1 including a first biasing device disposed between said guard member and the cutter bar for urging said guard member toward an extended position in which said guard member is moved toward a distal end of the cutter bar.

3. A chain saw safety guard as in claim 1 in which said cross-piece extends laterally across the cutter bar, said traveler of said forward support being movable distally along said longitudinal track to a forward stop point which is a predetermined distance from a distal end of the cutter bar.

4. A chain saw safety guard as in claim 3 in which, when said guard member is in an extended position in which said traveler is at said stop point, said rails extend from adjacent said stop point at said predetermined distance from the distal end of the cutter bar toward a proximal end of the cutter bar along portions of the side edges thereof.

5. A chain saw safety guard as in claim 1 in which said rail supports include a plurality of telescoping tubes which extend coaxially with said rails longitudinally along portions of the side edges of the cutter bar and are operatively coupled to said rails to permit said rails to move longitudinally along the side edges of said cutter bar while telescoping into said tubes.

6. A chain saw safety guard as in claim 5 in which said telescoping tubes are movably longitudinally relative to the cutter bar, whereby said rails and said tubes both protect against accidental contact with the side edges of the cutter bar.

7. In a chain saw having an elongate cutter bar extending outwardly from a motor housing for carrying a saw chain along its longitudinal side edges and around its distal end, a chain saw safety guard for protecting against accidental contact with the side edges of the cutter bar, the safety guard comprising:

a generally U-shaped guard member including a pair of generally parallel rails which extend between an open end of the U and a closed end of the U, the closed end of the U being defined by an interconnecting cross-piece, support means for supporting said guard member adjacent the cutter bar with said cross-piece of the U-shaped guard member oriented toward a distal end of the cutter bar and said rails extending proximally along the side edges of the cutter bar and spaced outwardly therefrom, said support means including a forward support for said cross-piece, said forward support includes a longitudinal track fixed relative to the cutter bar, a track-engaging traveler operatively connected to said cross-piece and reciprocally movable on and along said track, and a pair of rear rail supports fixed relative to the cutter bar and engaging said rails, said forward support and rail supports permitting longitudinal movement of said guard member along the cutter bar to retract said guard member when it is moved in a proximal direction along the cutter bar and to extend the guard member when it is moved in a distal direction, and a first biasing device disposed between said guard member and said cutter bar for urging said guard member in the distal direction, whereby the side edges of the cutter bar are protected by said rials except when the guard member is retracted.

8. A chain saw as in claim 7 in which said longitudinal track includes a longitudinal slot formed in the cutter bar.

9. A chain saw as in claim 8 in which said slot is an elongate opening through the cutter bar extending generally along a central longitudinal axis of the cutter bar.

10. A chain saw as in claim 7 in which said pair of rail supports are operatively secured to the cutter bar.

11. A chain saw as in claim 7 in which said longitudinal track of the support means terminates at a predetermined distance from a distal end of the cutter bar to permit said guard member to extend only to a predetermined stop point which is spaced a predetermined distance from the distal end of the cutter bar, such that the tip of the cutter bar, between said stop point and the distal end, is unprotected by said rials, whereby the tip of the chain saw cutter bar can be employed to initiate the cutting of an object and the saw subsequently manipulated to push the guard member against the object and retract the guard member while the saw is cutting the object.

12. A chain saw as in claim 7 in which said rail supports include a plurality of telescoping tubes which extend coaxially with said rails longitudinally along portions of the side edges of the cutter bar and are operatively coupled to said rials to permit said rials to move longitudinally relative to said cutter bar, whereby said rials and said tubes are all retractable and protect against accidental contact with the side edges of the cutter bar.

13. A chain saw safety device comprising:

an elongate cutter bar having a distal end, a proximal end, and a pair of longitudinal side edges;

a generally U-shaped guard member which includes a pair of guard rails extending generally parallel with one another between an open end of the U and a closed end of the U, the closed end of the U being defined by an interconnecting cross-piece;

rail supports interposed said cutter bar and said guard rails for supporting said rails in positions longitudinally adjacent to and spaced from said side edges of said cutter bar, said rial supports including telescoping tubes which extend coaxially with said guard rails longitudinally along portions of the side edges of the cutter bar, said tubes being movable longitudinally relative to said cutter bar and being operatively coupled with said guard rails to permit said rials to move longitudinally along said side edges of said cutter bar while telescoping into said tubes;

a first biasing device disposed between said guard member and said cutter bar for urging said guard member toward said distal end of said cutter bar;

a second biasing device disposed between said rials and said tubes for urging said telescoping tubes toward said distal end of said cutter bar; and a forward support which includes a longitudinal track fixed relative to said cutter bar and a track-engaging traveler operatively connected to said cross-piece and reciprocably movable on and along said track, whereby said guard member is supported relative to the cutter bar on said rail supports and said forward support, and said guard member is movably longitudinally along said cutter bar to expose said side edges of said cutter bar upon longitudinal engagement of said guard member.

14. A chain saw safety device as in claim 13 in which said longitudinal track includes a longitudinal slot formed in said cutter bar.

15. A chain saw safety device as in claim 14 in which said slot is an elongate opening through said cutter bar extending generally along a central longitudinal axis of said cutter bar.

16. A chain saw safety device as in claim 13 in which said first biasing device has at least one compression spring housed within at least one of said telescoping tubes and said second biasing device has at least one extension spring surrounding at least one of said telescoping tubes.

* * * * *